US011959198B2

(12) United States Patent
Kawakami et al.

(10) Patent No.: US 11,959,198 B2
(45) Date of Patent: Apr. 16, 2024

(54) KNIT FABRIC PRODUCTION METHOD, FABRIC PRODUCTION METHOD, AND SEWN PRODUCT PRODUCTION METHOD

(71) Applicant: KONDO COTTON SPINNING CO., LTD., Nagoya (JP)

(72) Inventors: Masatoshi Kawakami, Nagoya (JP); Yoshiaki Watai, Omachi (JP); Kyosuke Kanda, Omachi (JP); Yuki Shimizu, Tokyo (JP)

(73) Assignee: KONDO COTTON SPINNING CO., LTD., Nagoya (JP)

( * ) Notice: Subject to any disclaimer, the term of this patent is extended or adjusted under 35 U.S.C. 154(b) by 435 days.

(21) Appl. No.: 17/290,059

(22) PCT Filed: Nov. 12, 2019

(86) PCT No.: PCT/JP2019/044345
§ 371 (c)(1),
(2) Date: Apr. 29, 2021

(87) PCT Pub. No.: WO2020/105510
PCT Pub. Date: May 28, 2020

(65) Prior Publication Data

US 2021/0395925 A1 Dec. 23, 2021

(30) Foreign Application Priority Data

Nov. 19, 2018 (JP) ..... 2018-216662

(51) Int. Cl.
*D01H 1/115* (2006.01)
*D04B 1/14* (2006.01)
(Continued)

(52) U.S. Cl.
CPC ..... *D01H 1/115* (2013.01); *D04B 1/14* (2013.01); *D04B 15/48* (2013.01); *D04B 35/22* (2013.01); *D10B 2201/02* (2013.01)

(58) Field of Classification Search
CPC ..... D01H 1/115; D01H 7/92; D01H 7/923; D01H 7/926; D01H 2700/242; D02G 3/38; D04B 35/22
(Continued)

(56) References Cited

U.S. PATENT DOCUMENTS 4,565,063 A * 1/1986 Stalder ..... D01H 1/115 57/328
5,107,671 A * 4/1992 Morihashi ..... D01H 1/115 57/328
(Continued)

FOREIGN PATENT DOCUMENTS

CN 102926073 A 2/2013
CN 103132211 A 6/2013
(Continued)

OTHER PUBLICATIONS

English translation of JPS55107549, obtained via espacenet.com (last visited Aug. 31, 2023) (Year: 2023).*
(Continued)

*Primary Examiner* — Patrick J. Lynch
(74) *Attorney, Agent, or Firm* — BUCHANAN INGERSOLL & ROONEY PC

(57) ABSTRACT

A knit fabric production method includes a step of producing a knit fabric K1 from an untwisted yarn Y0 while producing the untwisted yarn Y0 by disposing a fiber bundle FB around a linear core member CP formed of a soluble polymer, falsely twisting the fiber bundle FB by using an air flow swirling in a predetermined first direction and simultaneously causing open end fibers OF to adhere to an outer
(Continued)

circumferential surface of the falsely twisted fiber bundle FB by using an air flow swirling in a second direction opposite the first direction, and untwisting the falsely twisted fiber bundle FB.

6 Claims, 8 Drawing Sheets

(51) Int. Cl.
*D04B 15/48* (2006.01)
*D04B 35/22* (2006.01)

(58) Field of Classification Search
USPC ..... 66/9 R
See application file for complete search history.

(56) References Cited

U.S. PATENT DOCUMENTS

| | | | | |
|---|---|---|---|---|
| 6,250,060 | B1 | 6/2001 | Scheerer et al. | |
| 6,405,519 | B1 * | 6/2002 | Shaikh | D02G 3/281 57/328 |
| 9,371,600 | B2 * | 6/2016 | Barth | D01H 7/92 |
| 2006/0272357 | A1 * | 12/2006 | Koenig | D04B 9/14 66/9 B |
| 2007/0087162 | A1 * | 4/2007 | Mandawewala | D02G 3/36 428/95 |
| 2011/0113831 | A1 * | 5/2011 | Bauer | D04B 35/14 66/163 |
| 2017/0022640 | A1 * | 1/2017 | Schenk | A45C 3/001 |
| 2017/0283992 | A1 * | 10/2017 | Bauer | D04B 9/14 |
| 2018/0317594 | A1 * | 11/2018 | Brinkman | D04B 1/12 |
| 2019/0055678 | A1 * | 2/2019 | Hightower, III | D02G 3/36 |

FOREIGN PATENT DOCUMENTS

| | | | |
|---|---|---|---|
| JP | S55107549 | A | 8/1980 |
| JP | S6065154 | A | 4/1985 |
| JP | H06-033332 | A | 2/1994 |
| JP | H0657547 | A | 3/1994 |
| JP | 2570663 | Y2 | 5/1998 |
| JP | 2002-520497 | A | 7/2002 |
| JP | 2004-250856 | A | 9/2004 |

OTHER PUBLICATIONS

Office Action (The First Office Action) dated Jul. 12, 2022, by the State Intellectual Property Office of People's Republic of China in corresponding Chinese Patent Application No. 201980068517.5 and an English Translation of the Office Action. (27 pages).

International Search Report (PCT/ISA/210) and Written Opinion (PCT/ISA/237) dated Feb. 10, 2020, by the Japanese Patent Office as the International Searching Authority for International Application No. PCT/JP2019/044345.

Asano et al., "New Fasciated Yarns," Toray Industries Inc, Fibers & Textiles Research Laboratories, (Month unknown 1982), vol. 38, No. 5, pp. 211-216.

* cited by examiner

KNIT FABRIC PRODUCTION METHOD, FABRIC PRODUCTION METHOD, AND SEWN PRODUCT PRODUCTION METHOD

TECHNICAL FIELD

The present invention relates to a method for producing a knit fabric, to a method for producing a fabric by using the knit fabric, and to a method for producing a sewn product by using the fabric.

BACKGROUND ART

For example, as disclosed in Patent Document 1 listed below, a method for producing a fabric by stacking a plurality of knit fabrics has been known. The fabric produced in this manner has a layer of air between the stacked knit fabrics. Therefore, the fabric has excellent heat retaining performance and soft texture. The fabric is used for, for example, bedclothes.

PRIOR ART DOCUMENT

Patent Document

Patent Document 1: Japanese Patent Application Laid-Open (kokai) No. S60-65154

SUMMARY OF THE INVENTION

Problem to be Solved by the Invention

In general, an untwisted yarn has a larger inter-fiber gap than does a yarn produced by using, for example, a ring spinning machine and that is actually twisted. Therefore, when a knit fabric is knitted by using an untwisted yarn, the produced knit fabric becomes light in weight and soft to the touch. However, the untwisted yarn itself is low in strength. In particular, it is difficult to maintain the strength of an untwisted yarn produced from natural fibers, such as cotton, at a level sufficiently high to endure knitting.

Also, in the fabric disclosed in Patent Document 1, the two knit fabrics are connected together at a plurality of locations. This maintains the structure (multiple structure) of a resultant fabric. However, in the case of a sewn product produced from a fabric having binding points, when the fabric shrinks as a result of washing, the fabric twists or wrinkles easily.

The present invention has been accomplished in view of the above-described point, and an object of the present invention is to provide a knit fabric production method which can realize a knit fabric which is light in weight and soft to the touch. Another object of the present invention is to provide a fabric production method and a sewn product production method which can realize a fabric which is light weight and voluminous, which has excellent heat retaining performance and soft texture, and which is less likely to twist or wrinkle due to shrinkage.

Means for Solving the Problem

In order to accomplish the above-described object, a knit fabric production method of the present invention comprises a step of producing a knit fabric (K1) from an untwisted yarn while producing the untwisted yarn through the steps of:

disposing a fiber bundle (FB) around a linear core member (CP) formed of a soluble polymer;

falsely twisting the fiber bundle by using an air flow swirling in a predetermined first direction and simultaneously causing open end fibers (OF) to adhere to an outer circumferential surface of the falsely twisted fiber bundle by using an air flow swirling in a second direction opposite the first direction; and untwisting the falsely twisted fiber bundle.

The knit fabric production method according to the present invention further comprises a step of dissolving the core member of the untwisted yarn constituting the knit fabric.

As described above, in general, the strength of an untwisted yarn itself is low. However, when an untwisted yarn including, as a core, a core member formed of a soluble polymer is used as in the case of the present invention, a knit fabric can be knitted. When the core member is dissolved and removed after the knitting, the sizes of the inter-fiber gaps of the knit fabric increase, and the apparent thickness (real yarn count) of the untwisted yarn constituting the knit fabric decreases. Namely, the present invention can realize a knit fabric which is soft to the touch and is light in weight. Since the untwisted yarn itself has no twist, the untwisted yarn is inferior in stretchability to a yarn produced by using an ordinary ring spinning machine. However, since a knit fabric produced by using the knit fabric production method of the present invention is formed by a series of loops formed by the untwisted yarn, the knit fabric has stretchability. Namely, the knit fabric according to the present invention has a sufficient degree of stretchability despite the knit fabric being composed of the untwisted yarn only.

A fabric production method of the present invention comprises:

a step of producing a knit fabric from an untwisted yarn while producing the untwisted yarn by disposing a fiber bundle around a linear core member formed of a soluble polymer, falsely twisting the fiber bundle by using an air flow swirling in a predetermined first direction and simultaneously causing open end fibers to adhere to an outer circumferential surface of the falsely twisted fiber bundle by using an air flow swirling in a second direction opposite the first direction, and untwisting the falsely twisted fiber bundle;

a step of removing the core member of the untwisted yarn constituting the knit fabric by dissolving the core member; and a step of laying on top of each other pieces of the knit fabric from which the core member has been removed.

A sewn product production method of the present invention comprises:

a step of producing a knit fabric from an untwisted yarn while producing the untwisted yarn by disposing a fiber bundle around a linear core member formed of a soluble polymer, falsely twisting the fiber bundle by using an air flow swirling in a predetermined first direction and simultaneously causing open end fibers to adhere to an outer circumferential surface of the falsely twisted fiber bundle by using an air flow swirling in a second direction opposite the first direction, and untwisting the falsely twisted fiber bundle;

a step of removing the core member of the untwisted yarn constituting the knit fabric by dissolving the core member;

a step of producing a fabric by laying on top of each other pieces of the knit fabric from which the core member has been removed; and a step of sewing the fabric.

As described above, the sizes of the inter-fiber gaps of the knit fabric are relatively large. Therefore, one end portion of each of many fibers of the fibers constituting the knit fabric enters the fiber bundle and the other end portion protrudes to the outside of the fiber bundle. Namely, the knit fabric has an appropriate degree of fluffing. When two such knit fabrics are laid one on top of the other, entanglement occur between fluff fibers of one knit fabric and fluff fibers of the other knit fabric. Also, some fluff fibers of the one knit fabric enter the spaces between adjacent portions of the untwisted yarn constituting the other knit fabric and twine around the untwisted yarn of the other knit fabric. Also, some fluff fibers of the one knit fabric enter the spaces between short fibers (staples) of the untwisted yarn constituting the other knit fabric and twine around the untwisted yarn of the other knit fabric. As a result, the two knit fabrics adhere to each other (fastening phenomenon). The fastening phenomenon maintains the structure (multiple structure) of the fabric produced by laying the two knit fabrics one on top of the other. Namely, the fabric according to the present invention does not have binding points for connecting the two knit fabrics. Therefore, in a sewn product produced from the fabric according to the present invention, twisting and wrinkling of the fabric due to washing are less likely to occur. Twisting and wrinkling are problems of a sewn product produced from a conventional fabric having binding points (double-layered plain stitch or the like). Also, since the fabric is formed by laying the two knit fabrics one on top of the other, the fabric has an increased strength as a single fabric. Moreover, since the fabric according to the present invention has stretchability, the fabric is less likely to tear. Namely, the durability of the sewn product is high. Also, since a layer of air is formed between the two knit fabrics, the fabric and the sewn product are excellent in heat retaining performance. Also, since the yarn of the present invention is an untwisted yarn, pilling formed as a result of the sewn product being washed and worn comes off easily. Therefore, the sewn product is superior in pilling prevention to a sewn product produced from a fabric produced by using a ring yarn. Meanwhile, although the yarn constituting the fabric and the sewn product according to the present invention is an untwisted yarn, the fiber bundle of the untwisted yarn is partially bound by the open end fibers. Therefore, a smaller amount of fibers come off as compared with a conventional untwisted yarn.

MODES FOR CARRYING OUT THE INVENTION

Figure 1:
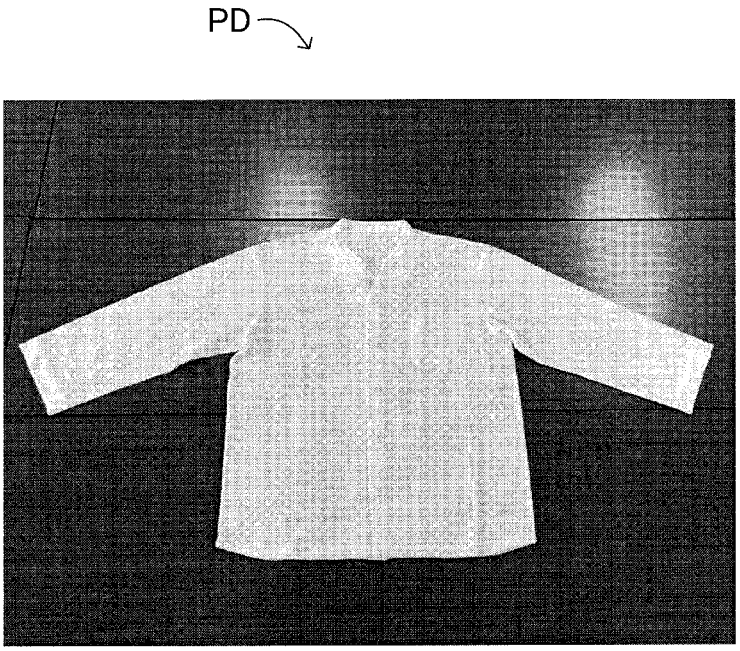
FIG. 1 Front view of a sewn product according to one embodiment of the present invention.

Now, as an example, steps (a knitting step, a layering step, and a sewing step) for producing a sewn product PD, as showing in FIG. 1, by using a sewn product production method according to the present embodiment will be described. Notably, the knitting step corresponds to the knit fabric production method of the present invention. Also, a series of steps composed of the knitting step and the layering step correspond to the fabric production method of the present invention. Also, a series of steps composed of the knitting step, the layering step, and the sewing step correspond to the sewn product production method of the present invention.

(Knitting Step)

The knitting step is a step of producing a knit fabric K1. The knit fabric K1 is produced by using a knit fabric production apparatus 1 shown in FIG. 2. The knit fabric production apparatus 1 knits the knit fabric K1 by using an untwisted yarn Y0 while producing the untwisted yarn Y0. Namely, the knit fabric production apparatus 1 performs spinning and knitting simultaneously (continuously).

Figure 2:
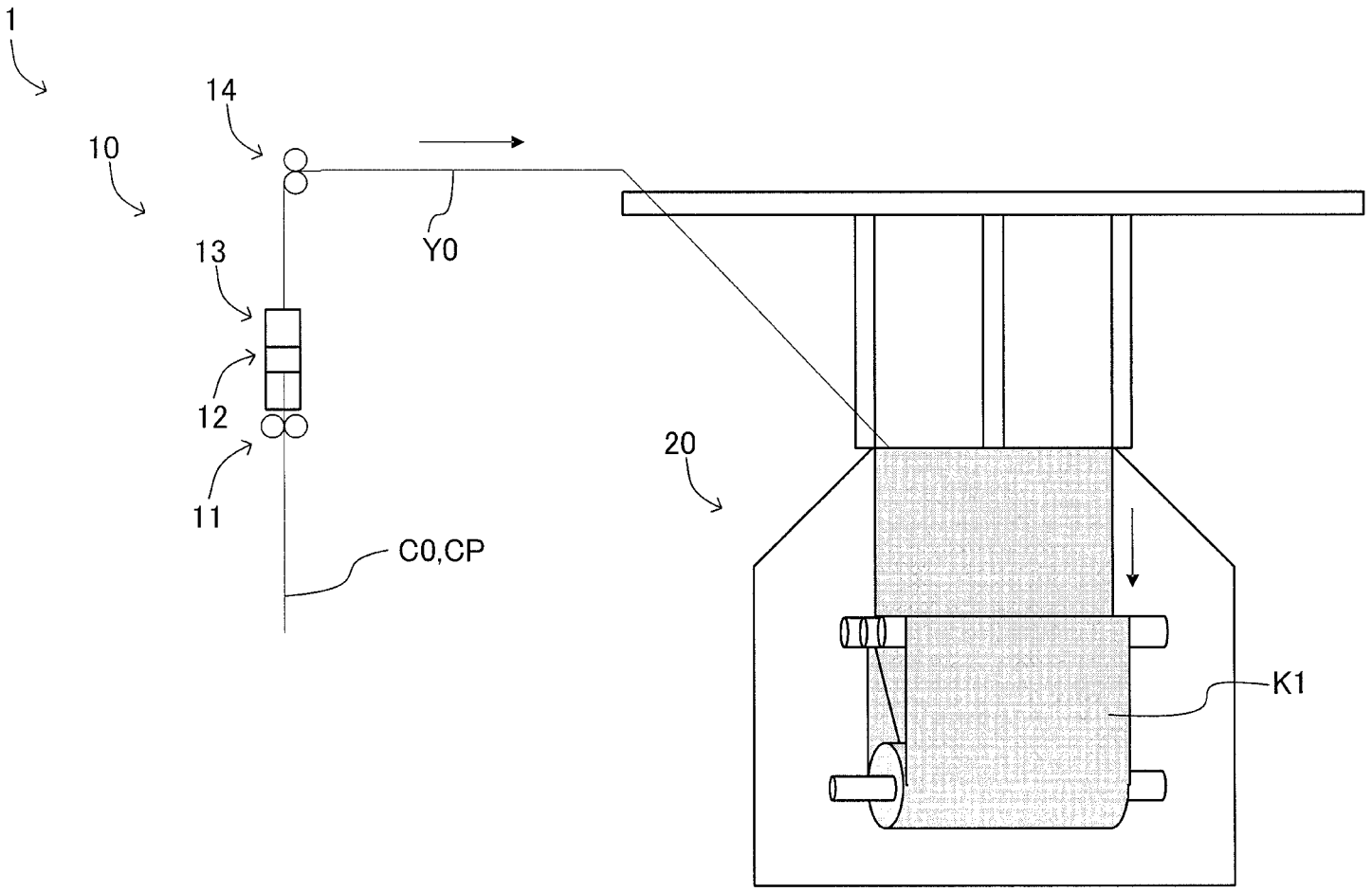
FIG. 2 Schematic view of a knit fabric production apparatus.

Next, the structure of the knit fabric production apparatus 1 will be described. As shown in FIG. 2, the knit fabric production apparatus 1 includes a spinning machine 10 and a knitting machine 20. As will be described below, the spinning machine 10 is an apparatus for producing the untwisted yarn Y0, and the knitting machine 20 is an apparatus for producing the knit fabric K1 by using the untwisted yarn Y0.

Figure 3:
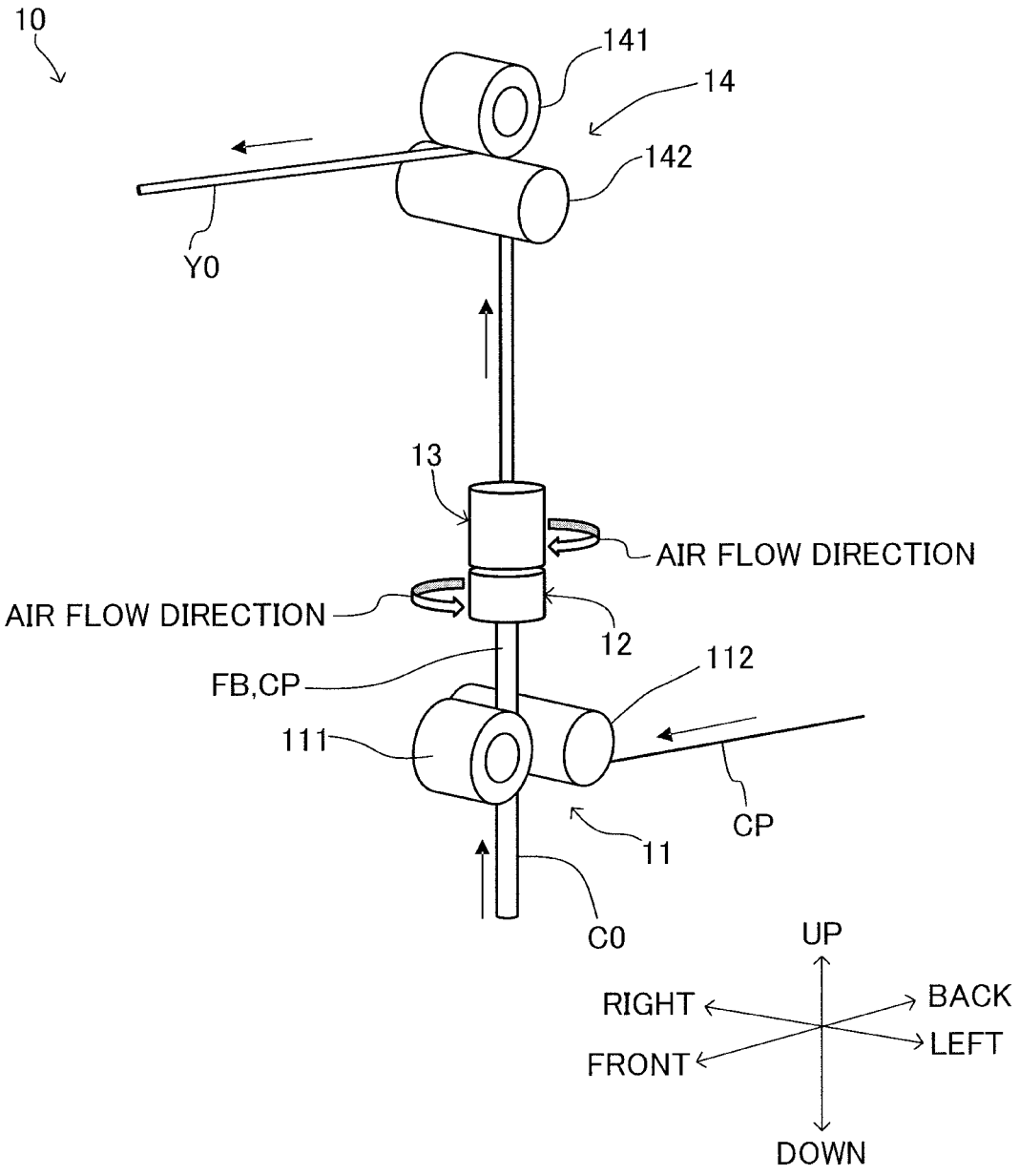
FIG. 3 Schematic view of a spinning machine.

As shown in FIG. 3, the spinning machine 10 includes a front roller unit 11, a first nozzle 12, and a second nozzle 13, and a delivery roller unit 14. The front roller unit 11, the first nozzle 12, the second nozzle 13, and the delivery roller unit 14 are arranged in this order in the vertical direction. The front roller unit 11 is located at the lowermost position, and the delivery roller unit 14 is located at the uppermost position. In the following description, one of two directions which extend horizontally and are orthogonal to each other will be referred to as a left-right direction, and the other of the two directions will be referred to as a front-back direction.

The front roller unit 11 includes a front-side roller 111 and a rear-side roller 112 each of which has a cylindrical columnar shape and extends in the left-right direction. The front-side roller 111 and the rear-side roller 112 are disposed in such a manner that the front-side roller 111 and the rear-side roller 112 are slightly separated from each other in the front-back direction. The front-side roller 111 and the rear-side roller 112 are supported to be rotatable about their center axes.

Each of the first nozzle 12 and the second nozzle 13 is a tubular member extending in the vertical direction. The first nozzle 12 and the second nozzle 13 generate air flows swirling along their inner circumferential surfaces. The swirling direction of air within the first nozzle 12 is opposite the swirling direction of air within the second nozzle 13. The center axis of the first nozzle 12 and the center axis of the second nozzle 13 are disposed on a common straight line extending in the vertical direction.

The delivery roller unit 14 includes an upper-side roller 141 and a lower-side roller 142 each of which has a cylindrical columnar shape and extends in the left-right direction. The upper-side roller 141 and the lower-side roller 142 are disposed in such a manner that the upper-side roller 141 and the lower-side roller 142 are slightly separated from each other in the vertical direction. The upper-side roller 141 and the lower-side roller 142 are supported to be rotatable about their center axes.

Cotton C0, which is a raw material, and a thread-like core member CP formed of water-soluble vinylon are supplied to the space between the front-side roller 111 and the rear-side roller 112 from the lower side of the front roller unit 11. When the cotton C0 passes through the front roller unit 11, the cotton C0 supplied to the front roller unit 11 is untangled, and the fibers of the cotton C0 are aligned to extend in the vertical direction. As a result, a fiber bundle FB extending in the vertical direction is formed. The core member CP has been inserted to a central portion of the fiber bundle FB. Namely, the core member CP is covered with the fiber bundle FB.

As a result of the front roller unit 11 and the delivery roller unit 14 being driven to rotate their rollers, the fiber bundle FB including the core member CP as a core as described above is fed from the front roller unit 11 side toward the delivery roller unit 14 side. Namely, the fiber bundle FB including the above-described core member CP as a core is fed upward from the front roller unit 11, passes through the central portions of the first nozzle 12 and the second nozzle 13, and reaches the delivery roller unit 14.

At that time, the fiber bundle FB is twisted falsely by the air flow generated inside the second nozzle 13, and open end fibers OF are sprayed onto the outer circumferential surface of the falsely twisted fiber bundle FB by the air flow generated inside the first nozzle 12. Notably, the open end fibers OF are some of the fibers aligned to be parallel by the front roller unit 11 which are not contained in the fiber bundle FB and exist independently. The fiber bundle FB twisted falsely and having the open end fibers OF adhering to its surface as described above is fed out forward from the delivery roller unit 14. As a result, the portion of the falsely-twisted fiber bundle FB having been fed out from the delivery roller unit 14 is untwisted. As a result of this action, the open end fibers OF adhering to the surface of the fiber bundle FB are wound around the outer circumferential surface of the fiber bundle FB in the direction opposite the direction of the false twisting. In this manner, the untwisted yarn Y0 having the core member CP as a core is produced.

Notably, within the range in which the untwisted yarn Y0 can keep the shape as a yarn, the strength (pressure and flow velocity) of the air flow of the second nozzle 13 is set as low as possible. Also, the fineness (in tex) of the core member CP of the present embodiment is 44 dtex, and the English cotton count of the untwisted yarn Y0 is 46.

The untwisted yarn Y0 produced in the above-described manner is supplied from the delivery roller unit 14 directly to the knitting machine 20. The knitting machine 20 is a well known single circular knitting machine. The cylinder diameter of the knitting machine 20 is 30 inches, and the gauge is set to 28 G. Also, the yarn length per round is set to about 650 cm/round. The knitting machine 20 produces the knit fabric K1 from the untwisted yarn Y0 through a plain stitch process.

Figure 4:
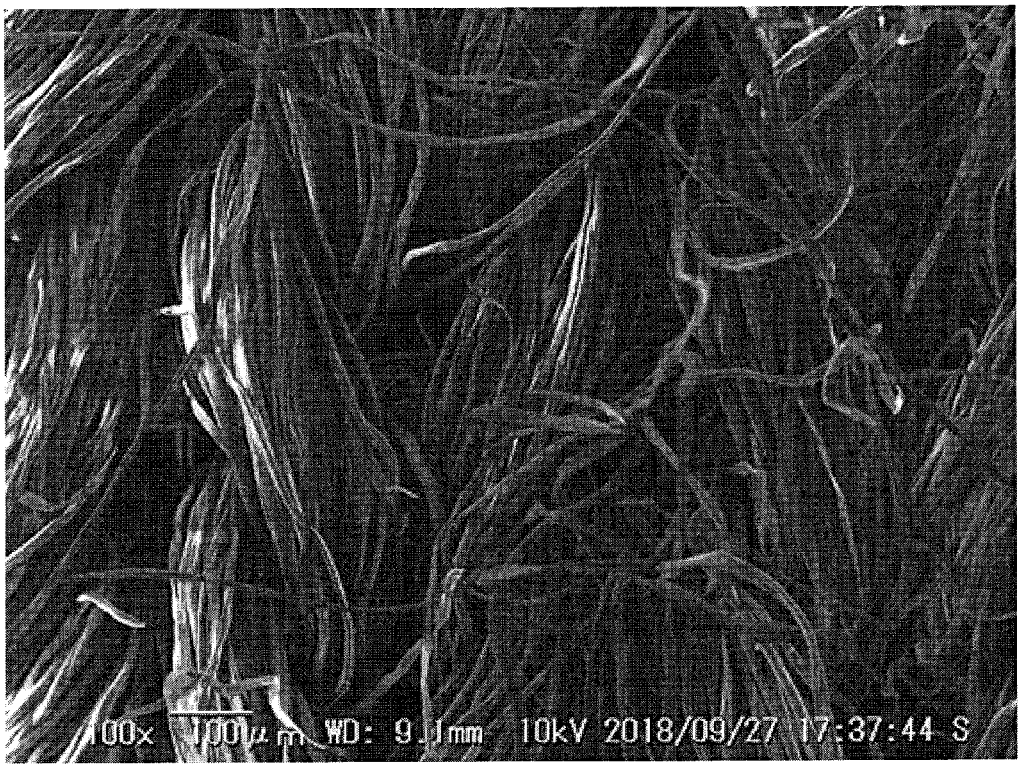
FIG. 4 Enlarged photograph of the surface of a knit fabric.

Next, the knit fabric K1 is soaked into hot water of 60° C. for 30 minutes so as to dissolve and remove the core member CP of the untwisted yarn Y0 constituting the knit fabric K1. The liquor ratio before dissolution of the core member CP of the untwisted yarn Y0 is "1:30" to "1:50," and the liquor ratio after dissolution of the core member CP of the untwisted yarn Y0 is "1:50" to "1:70." Removal of the core member CP as described above increases the sizes of the gaps between the fibers (stables) of the untwisted yarn Y0 constituting the knit fabric K1 and increases the degree of fluffing (see FIG. 4). Also, as a result of removal of the core member CP, the weight of the knit fabric K1 decreases. Therefore, although the English cotton count of the untwisted yarn Y0 before dissolution of the core member CP is 46, the English cotton count of the untwisted yarn Y0 after dissolution of the core member CP is about 70.

Figure 5:
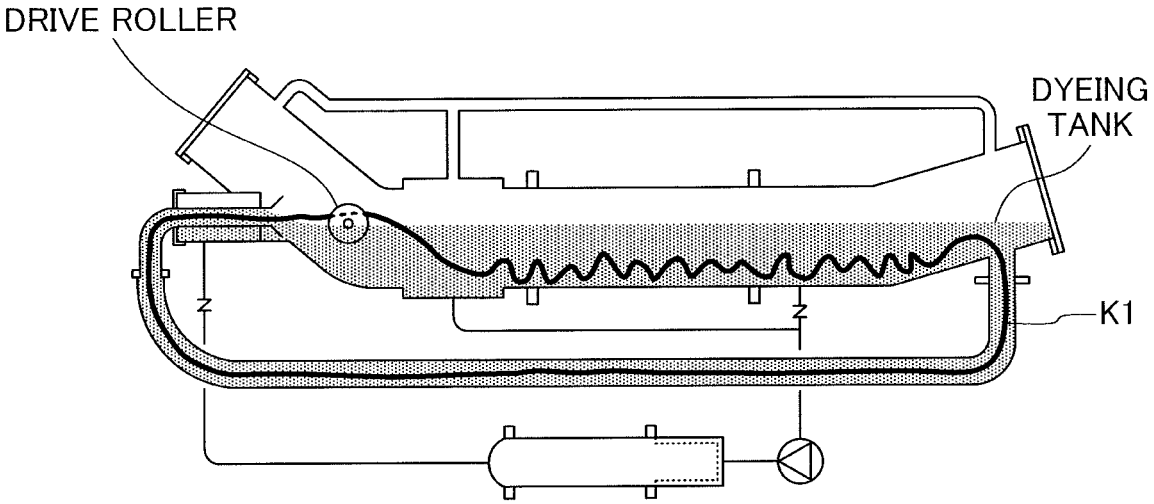
FIG. 5 Schematic view of a dyeing apparatus.

Next, the knit fabric K1 from which the core member CP has been removed in the above-described manner is dyed by using a dyeing machine. Because the untwisted yarn Y0 from which the core member CP has been removed is weak in binding force, the knit fabric K1 is likely to wrinkle during dyeing. Namely, in a general dyeing machine, when a knit fabric is pulled up vertically by drive rollers, a longitudinal wrinkle is easily formed due to the weight of the knit fabric itself. In order to overcome such a drawback, in the present embodiment, a dyeing machine as shown in FIG. 5 is used. In this dyeing machine, the knit fabric K1 is fed in a lateral direction (horizontal direction) by a drive roller. The knit fabric K1 is soaked in a dyeing liquid (floats on the dyeing liquid) from beginning to end. Therefore, load stemming from the weight of the knit fabric K1 is less likely to act on the knit fabric K1, and a longitudinal wrinkle is less likely to be formed on the knit fabric K1. Notably, in the present embodiment, the feed speed of the knit fabric K1 is set to 70 to 100 m/min.

Next, neutralization treatment, soaping treatment, and softening treatment, which are well known, are carried out. Notably, in order to impart an appropriate degree of fluffing to the knit fabric K1, an anion fabric softener of 5% owf is preferably used in the softening treatment.

Figure 6:
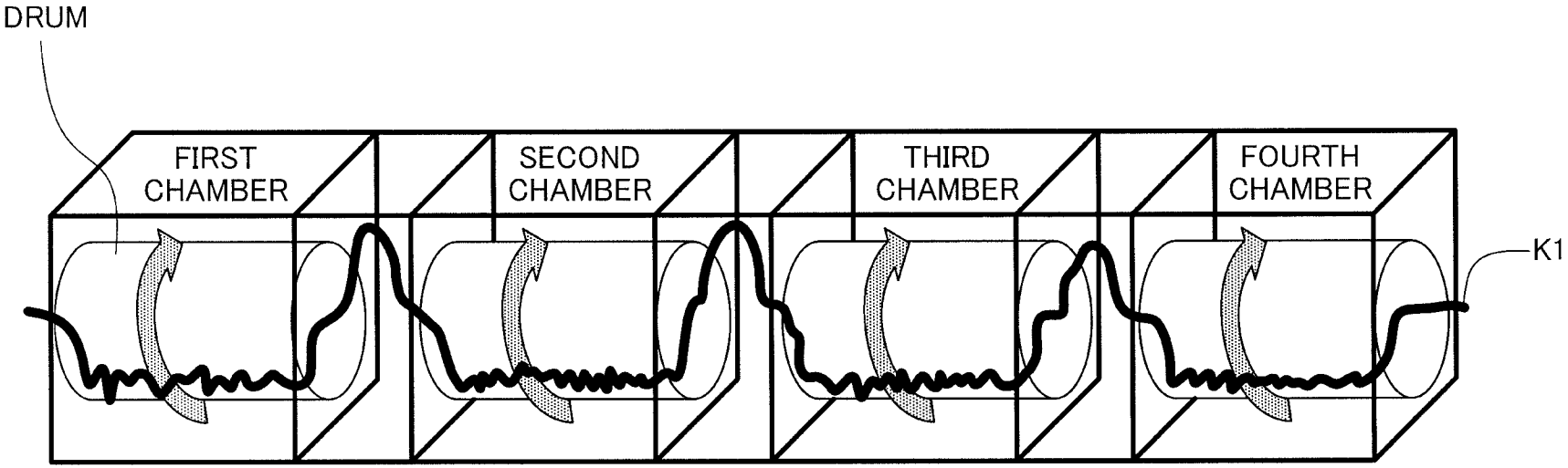
FIG. 6 Schematic view of a dryer.

Next, the knit fabric K1 is dried by using a dryer. At that time, the degree of fluffing of the surface of the knit fabric K1 increases when a continuous tumbler dryer shown in FIG. 6 is used and its temperature is set to 80° C.

(Layering Step)

Figure 7:
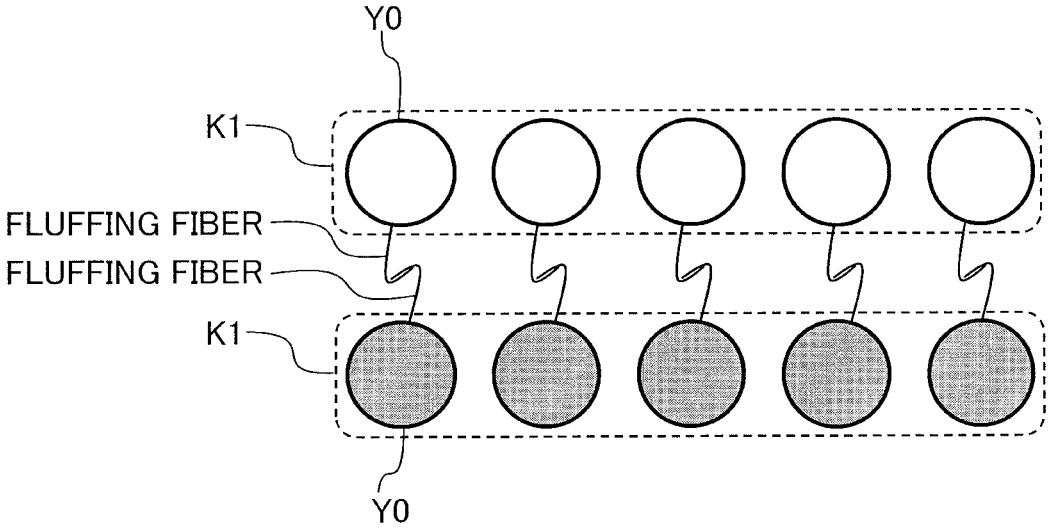
FIG. 7 Sectional view schematically showing a state in which fluff fibers are entangled with each other.
Figure 8:
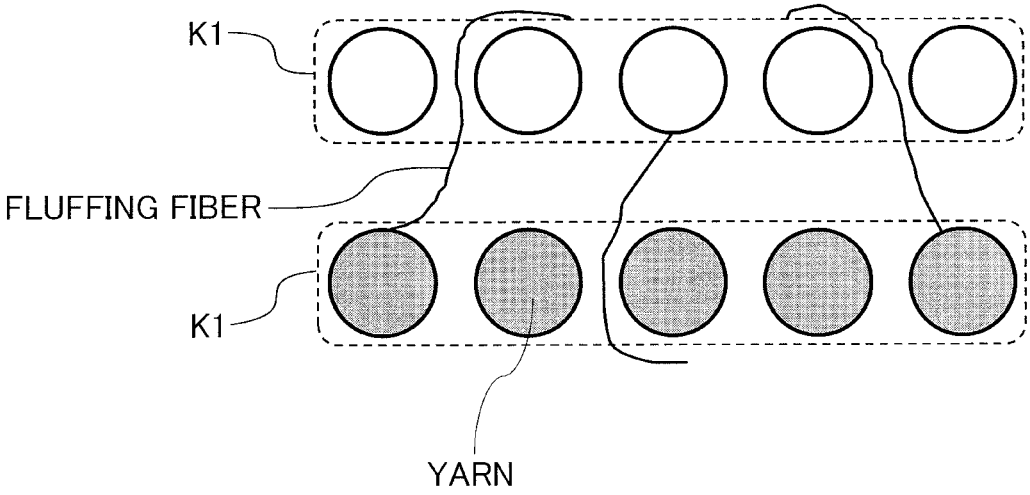
FIG. 8 Sectional view schematically showing a state in which fluff fibers intervene between two untwisted yarns.
Figure 9:
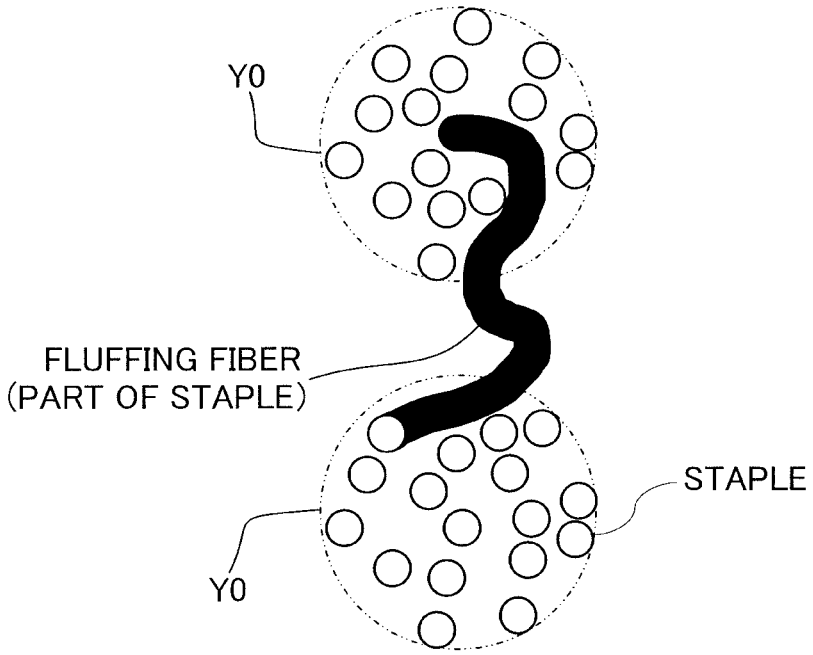
FIG. 9 Sectional view schematically showing a state in which a fluff fiber intervenes between staples constituting an untwisted yarn.
Figure 10:
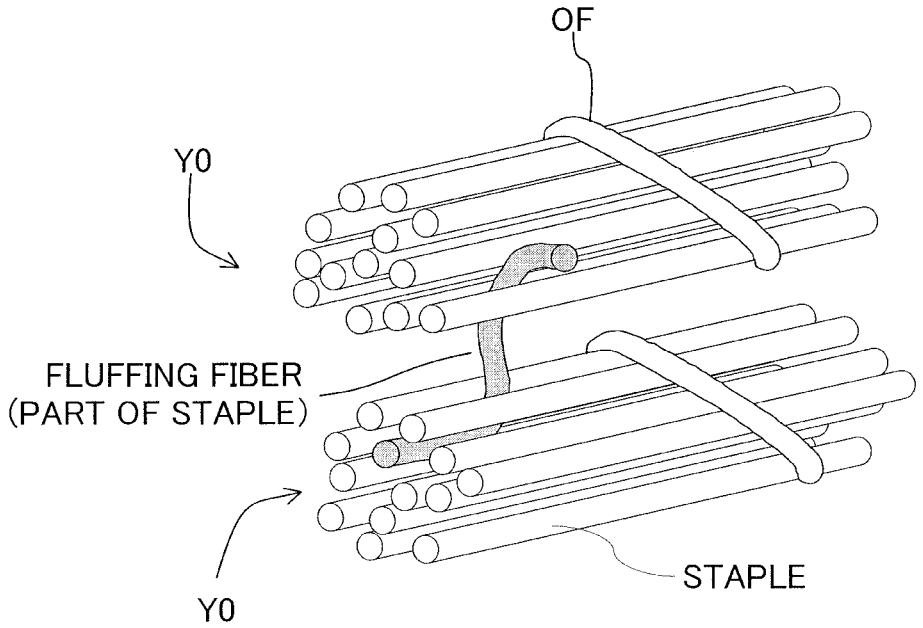
FIG. 10 Perspective view schematically showing a state in which a fluff fiber intervenes between staples constituting an untwisted yarn.

Next, a fabric C1 is produced by laying two knit fabrics K1 one on top of the other. At that time, the two knit fabrics K1 are laid one on top of the other in such a manner that the front surface of one knit fabric K1 comes into contact with the back surface of the other knit fabric K1. As a result, as shown in FIG. 7, entanglement occurs between fluff fibers of the one knit fabric K1 and fluff fibers of the other knit fabric K1. Also, as shown in FIG. 8, some fluff fibers of the one knit fabric K1 enter the spaces between adjacent portions of the untwisted yarn Y0 constituting the other knit fabric K1 and twine around the untwisted yarn Y0 of the other knit fabric K1. Also, as shown in FIGS. 9 and 10, some fluff fibers of the one knit fabric K1 enter the spaces between short fibers (staples) of the untwisted yarn Y0 constituting the other knit fabric K1 and twine around the untwisted yarn Y0 of the other knit fabric K1. As a result, the knit fabrics K1 adhere to each other. Hereinbelow, this phenomenon will be referred as a fastening phenomenon.

Here, the results of measurement of the adhesion between the two knit fabrics K1 constituting the fabric C1 will be shown. First, as a comparative example of the fabric C1, a knit fabric K2 was produced by using a ring spinning machine. The knit fabric K2 was produced by plain stitch from a yarn whose English cotton count is 80 (ordinary, really twisted yarn) in such a manner that the gram per square meter of the knit fabric K2 approximately coincides with the gram per square meter (69 g/m$^2$) of the knit fabric K1 (see Table 1).

TABLE 1

| Knit fabric | Yarn count before removal of core member CP | Yarn count after removal of core member CP | Gram per square meter of fabric ($g/m^2$) |
|---|---|---|---|
| K1 | 46 | 70 | 69 |

| Knit fabric | Yarn count | Gram per square meter of fabric ($g/m^2$) |
|---|---|---|
| K2 | 80 | 69 |

A method for quantitatively measuring the adhesion (adhering force) of knit fabric has not yet been established at present. Therefore, by referring to the method for measuring bonding strength prescribed in "JIS L3416 hook-and-loop fastener," the tensile shear strength and peeling strength of the fabric C1 and the tensile shear strength and peeling strength of the fabric C2 were measured. Notably, the fabric C1 is produced by laying pieces of the knit fabric K1 on top of each other, and the fabric C2 is produced by laying pieces of the knit fabric K2 on top of each other.

(Method for Measuring Tensile Shear Strength)

From each of the fabric C1 and the fabric C2, seven specimens extending in the course direction and seven specimens extending in the wale direction were collected. The size of each specimen is 10 cm×2.5 cm. Subsequently, two knit fabrics constituting each specimen are separated from each other and then disposed in such a manner that the two knit fabrics are shifted in relation to each other in the longitudinal direction. The two knit fabrics are then laid one on top of the other. At that time, the two knit fabrics are disposed in such a manner that the overlapped portions have a length of 5 cm. Subsequently, a roller is placed on the overlapped portions, and the roller is reciprocated twice between first ends of the overlapped portions and second ends of the overlapped portions. Notably, the width of the roller is equal to or greater than the effective width of each specimen, and the weight of the roller is 2.5 kg.

Next, a tensile test was carried out by using a tensile tester in which an end portion (end portion opposite the overlapped portion) of one knit fabric of each specimen was attached to an upper gripper of the tensile tester, and an end portion (end portion opposite the overlapped portion) of the other knit fabric was attached to a lower gripper of the tensile tester. A pulling speed of 30 cm/min was employed. The maximum tensile shear load S at which separation of the knit fabrics constituting each specimen had occurred was measured. Tensile shear strength F1 per unit area was calculated by the following expression (1). Five specimens were chosen from the seven specimens extending in the course direction by excluding a specimen whose tensile shear strength F1 was the highest and a specimen whose tensile shear strength F1 was the lowest, and the average of the tensile shear strengths F1 of the chosen five specimens was calculated. Similarly, five specimens were chosen from the seven specimens extending in the wale direction by excluding a specimen whose tensile shear strength F1 was the highest and a specimen whose tensile shear strength F1 was the lowest, and the average of the tensile shear strengths F1 of the chosen five specimens was calculated.

[Expression 1]

$$F1 = \frac{S}{2.5 \times L} \tag{1}$$

where F1: tensile shear strength ($cN/cm^2$)

S: maximum tensile shear load (cN)

L: overlapping length (cm)

(Method for Measuring Peeling Strength)

From each of the fabric C1 and the fabric C2, seven specimens extending in the course direction and seven specimens extending in the wale direction were collected. The size of each specimen is 10 cm×2.5 cm. Subsequently, two knit fabrics constituting each specimen are separated from each other and are disposed in such a manner that the two knit fabrics do not deviate from each other in the longitudinal direction. Portions of the two knit fabrics extending from their central portions to their first ends in the longitudinal direction are laid one on top of the other. Namely, the overlapped portions have a length of 5 cm. Portions of the two knit fabrics extending from their central portions to their second ends in the longitudinal direction are separated from each other. Subsequently, a roller is placed on the overlapped portions, and the roller is reciprocated twice between first ends of the overlapped portions and second ends of the overlapped portions. Notably, the width of the roller is equal to or greater than the effective width of each specimen, and the weight of the roller is 2.5 kg.

Next, a tensile test was carried out by using the tensile tester in which the second end portion (end portion opposite the overlapped portion) of one knit fabric of each specimen was attached to the upper gripper of the tensile tester, and the second end portion (end portion opposite the overlapped portion) of the other knit fabric was attached to the lower gripper of the tensile tester. A pulling speed of 30 cm/min was employed. In this manner, the knit fabrics constituting each specimen were peeled from each other. Peeling load was calculated as follows. Of local maximums of tensile load during the peeling process, top six local maximums were employed. Also, of local minimums of tensile load (peeling load) during the peeling process, bottom six local minimums were employed. Next, the average value P of the twelve peeling loads was calculated. Subsequently, peeling strength F2 per unit width (1 cm) was calculated by using the following expression (2). Five specimens were chosen from the seven specimens extending in the course direction by excluding a specimen whose peeling strength F2 was the highest and a specimen whose peeling strength F2 was the lowest, and the average of the peeling strengths F2 of the chosen five specimens was calculated. Similarly, five specimens were chosen from the seven specimens extending in the wale direction by excluding a specimen whose peeling strength F2 was the highest and a specimen whose peeling strength F2 was the lowest, and the average of the peeling strengths F2 of the chosen five specimens was calculated.

[Expression 2]

$$F2 = \frac{P}{2.5} \tag{2}$$

where F2: peeling strength (cN/cm)

P: average of peeling loads (cN)

Table 2 shows the results of measurement of the above-described tensile shear strength and the above-described peeling strength. Notably, in the peeling strength test for the fabric C2, since the degree of adhesion of the fabric C2 was low and no local maximum which shows peeling could not be obtained, measurement of peeling load could not be performed. Meanwhile, the measurement results of the fabric C1 show that the fabric C1 is higher than the fabric C2 in terms of shear strength and peeling strength. Namely, in the case of the fabric C1, relatively large adhering force was obtained thanks to the fastening phenomenon having been described with reference to FIGS. 7 to 10.

TABLE 2

| | Shear strength (cN/cm$^2$) | | Peeling strength (cN/cm) | |
|---|---|---|---|---|
| Fabric | Course direction | Wale direction | Course direction | Wale direction |
| C1 | 0.10 ± 0.01 | 0.12 ± 0.02 | 0.03 ± 0.00 | 0.03 ± 0.01 |
| C2 | 0.04 ± 0.01 | 0.04 ± 0.01 | —[1)] | —[1)] |

[1)]Could not been measured because peeling load was small and no local maximum was obtained.

(Sewing Step)

Finally, the fabric C1 produced in the above-described manner is appropriately cut and sewn to produce a sewn product PD.

As described above, in general, the strength of an untwisted yarn itself is low. In particular, it is difficult to maintain the strength of an untwisted yarn produced from natural fibers, such as cotton, at a level high enough to endure knitting. In view of this, in the present embodiment, the untwisted yarn Y0 including, as a core, the core member CP formed of a water-soluble polymer is used. Thus, the knit fabric K1 can be knitted from the untwisted yarn Y0. When the core member CP is dissolved and removed after that, the sizes of the inter-fiber gaps of the knit fabric K1 increase, and the apparent thickness (real yarn count) of the untwisted yarn Y0 constituting the knit fabric K1 decreases. As a result, the obtained knit fabric K1 is soft to the touch, is light in weight, and has an appropriate degree of fluffing. Also, since the untwisted yarn Y0 itself has no twist, the untwisted yarn Y0 is inferior in stretchability to a yarn produced by using an ordinary ring spinning machine. However, since the knit fabric K1 is formed by a series of loops formed by the untwisted yarn Y0, the knit fabric K1 has stretchability. Accordingly, the knit fabric K1 has a sufficient degree of stretchability despite the fact that the knit fabric K1 is composed of the untwisted yarn Y0 only.

Further, when the two knit fabrics K1 are laid one on top of the other, the fastening phenomenon occurs, whereby the two knit fabrics K1 can be adhered to each other. This fastening phenomenon maintains the structure (multiple structure) of the fabric C1. Namely, the fabric C1 does not have binding points for connecting the two knit fabrics K1. In the sewn product PD produced from the fabric C1, twisting and wrinkling of the fabric due to washing are less likely to occur. Twisting and wrinkling are problems of a sewn product produced from a conventional fabric having binding points (double-layered plain stitch or the like). Also, since the fabric C1 is formed by laying the two knit fabrics K1 one on top of the other, the strength of the fabric C1 as a single fabric increases. Moreover, since the fabric C1 has stretchability, the fabric C1 is less likely to tear. Therefore, the durability of the sewn product PD is high. Also, since a layer of air is formed between the two knit fabrics K1, the fabric C1 and the sewn product PD are excellent in heat retaining performance. Also, since the sewn product PD is composed of the untwisted yarn Y0, pilling formed as a result of the sewn product PD being washed or worn come off easily. Therefore, the sewn product PD is superior in pilling prevention to a sewn product produced from a fabric produced by using a ring yarn. Meanwhile, the fiber bundle FB of the untwisted yarn Y0 is partially bound by the open end fibers OF. Therefore, a smaller amount of fibers come off as compared with a conventional untwisted yarn.

Moreover, the present invention is not limited to the above-described embodiment, and various modifications can be made without departing form the purpose of the present invention.

As described above, the fabric C1 is characterized in that it is thin and light in weight, it is voluminous, it is excellent in heat retaining performance, it is soft and excellent in texture, it is less likely to shrink, twist, or wrinkle after washing, and it has an appropriate degree of stretchability. Taking advantage of these characteristics, the fabric C1 can be used in a wide variety of applications, for example, nightclothes such as pajamas and gowns; bedclothes such as bed sheets; underclothes; T-shirts; blankets; gloves; neck warmers; arm covers; sportswear; other types of clothing; interior fabrics such as cushion covers; and other industrial materials.

Also, for example, the fineness of the core member CP is not limited to the fineness employed in the above-described embodiment. However, it is preferred that the fineness (in tex) of the core member CP be 30 dtex to 50 dtex. Also, the English cotton count of the untwisted yarn Y0 is not limited to the English cotton count employed in the above-described embodiment. However, it is preferred that the English cotton count of the untwisted yarn Y0 be 30 to 70. Also, the material of the core member CP is not limited to water-soluble vinylon, and the core member CP may be formed of any of other soluble materials. For example, the core member CP may be formed of water-soluble polyester.

The invention claimed is:

1. A knit fabric production method comprising a step of producing a knit fabric from an untwisted yarn while producing the untwisted yarn by advancing a linear core member formed of a soluble polymer and a fiber bundle around the linear core in a predetermined direction between a first roller unit and a second roller unit which are arranged apart in the predetermined direction, falsely twisting the fiber bundle by using an air flow swirling in a predetermined first direction and simultaneously causing open end fibers to adhere to an outer circumferential surface of the falsely twisted fiber bundle by using an air flow swirling in a second direction opposite the first direction, untwisting the falsely twisted fiber bundle, advancing the untwisted yarn to a knitting machine directly from the second roller unit, and knitting the untwisted yarn by the knitting machine.

2. A knit fabric production method according to claim 1, further comprising a step of dissolving the core member of the untwisted yarn constituting the knit fabric.

3. A knit fabric production method according to claim 1, wherein the fineness of the of the linear core member is 30 dtex to 50 dtex, and the English cotton count of the untwisted yarn is 30 to 70.

4. A knit fabric production method according to claim 3, further comprising a step of dissolving the core member of the untwisted yarn constituting the knit fabric.

5. A fabric production method comprising:

a step of producing a knit fabric from an untwisted yarn while producing the untwisted yarn by advancing a linear core member formed of a soluble polymer and a fiber bundle around the linear core in a predetermined direction between a first roller unit and a second roller unit which are arranged apart in the predetermined direction, falsely twisting the fiber bundle by using an air flow swirling in a predetermined first direction and simultaneously causing open end fibers to adhere to an outer circumferential surface of the falsely twisted fiber bundle by using an air flow swirling in a second direction opposite the first direction, untwisting the falsely twisted fiber bundle, advancing the untwisted yarn to a knitting machine directly from the second roller unit, and knitting the untwisted yarn by the knitting machine;

a step of removing the core member of the untwisted yarn constituting the knit fabric by dissolving the core member; and a step of laying at least the two knitted fabrics from which the core member has been removed and entangling the fluffs of the knitted fabrics to bring the knitted fabrics into close contact with each other to produce a fabric.

6. A sewn product production method comprising:

a step of producing a knit fabric from an untwisted yarn while producing the untwisted yarn by advancing a linear core member formed of a soluble polymer and a fiber bundle around the linear core in a predetermined direction between a first roller unit and a second roller unit which are arranged apart in the predetermined direction, falsely twisting the fiber bundle by using an air flow swirling in a predetermined first direction and simultaneously causing open end fibers to adhere to an outer circumferential surface of the falsely twisted fiber bundle by using an air flow swirling in a second direction opposite the first direction, untwisting the falsely twisted fiber bundle, advancing the untwisted yarn to a knitting machine directly from the second roller unit, and knitting the untwisted yarn by the knitting machine;

a step of removing the core member of the untwisted yarn constituting the knit fabric by dissolving the core member;

a step of laying at least the two knitted fabrics from which the core member has been removed and entangling the fluffs of the knitted fabrics to bring the knitted fabrics into close contact with each other to produce a fabric; and a step of sewing the fabric.

* * * * *